US008171852B1

(12) United States Patent
Rebar

(10) Patent No.: US 8,171,852 B1
(45) Date of Patent: May 8, 2012

(54) EXPANDING PROJECTILE

(76) Inventor: Peter Rebar, Strongsville, OH (US)

( * ) Notice: Subject to any disclaimer, the term of this patent is extended or adjusted under 35 U.S.C. 154(b) by 162 days.

(21) Appl. No.: 12/283,765

(22) Filed: Sep. 16, 2008

Related U.S. Application Data

(63) Continuation-in-part of application No. 11/977,373, filed on Oct. 24, 2007, now abandoned.

(60) Provisional application No. 60/853,820, filed on Oct. 24, 2006.

(51) Int. Cl.
*F42B 12/34* (2006.01)

(52) U.S. Cl. ..... 102/510; 102/509

(58) Field of Classification Search ..... 102/398, 102/501, 507, 508, 509, 510, 514, 515, 516, 102/517, 518, 519, 439, 448, 491, 492, 493; 411/80.5, 32, 41, 45, 46, 47, 48, 60.1, 44, 411/61.1, 60.2, 54.1
See application file for complete search history.

(56) References Cited

U.S. PATENT DOCUMENTS

| | | | | | |
|---|---|---|---|---|---|
| 252,489 | A | * | 1/1882 | Mefford | 102/519 |
| 644,361 | A | * | 2/1900 | Luciani | 102/519 |
| 904,255 | A | * | 11/1908 | Gathmann | 102/518 |
| 1,201,935 | A | * | 10/1916 | Campbell | 102/525 |
| 1,322,662 | A | | 11/1919 | Watson | |
| 1,493,614 | A | | 5/1924 | Dickerman | |
| 2,401,380 | A | * | 6/1946 | Teitscheid | 102/519 |
| 3,427,976 | A | * | 2/1969 | Lucy | 102/507 |
| 3,525,365 | A | * | 8/1970 | Boyle et al. | 138/89 |
| 4,016,817 | A | * | 4/1977 | Arciniega Blanco | 102/519 |
| 4,301,737 | A | | 11/1981 | Yuhash et al. | |
| 4,307,666 | A | * | 12/1981 | Baran | 102/525 |
| 4,403,377 | A | * | 9/1983 | Mizusawa | 24/681 |
| 4,474,517 | A | * | 10/1984 | Navoczynski | 411/45 |
| 4,612,860 | A | | 9/1986 | Flatau | |
| 4,665,827 | A | * | 5/1987 | Ellis, II | 102/517 |
| 4,682,546 | A | * | 7/1987 | Chovich | 102/517 |
| 4,878,434 | A | | 11/1989 | Sommet | |
| 4,938,147 | A | | 7/1990 | Czetto, Jr. | |
| 5,009,166 | A | | 4/1991 | Bilsbury et al. | |
| 5,160,805 | A | | 11/1992 | Winter | |
| 5,388,524 | A | * | 2/1995 | Strandli et al. | 102/529 |
| 6,090,756 | A | * | 7/2000 | Brown | 102/511 |
| 6,349,651 | B1 | * | 2/2002 | Martinez Garcia | 102/517 |
| 6,526,893 | B2 | | 3/2003 | May et al. | |

(Continued)

OTHER PUBLICATIONS

Hornady, New Hornady InterBond An all new bonded core bullet from Hornady, unknown date, page, volume, Hornady, Inc.

(Continued)

*Primary Examiner* — Michael Carone
*Assistant Examiner* — Jonathan C Weber
(74) *Attorney, Agent, or Firm* — McDonald Hopkins LLC

(57) ABSTRACT

An improved projectile having a penetrator and a body is disclosed. The penetrator is secured to the body. Upon impacting a target, the pentrator travels into the body and deforms the body. The body optionally has one or more portions, such as slots in the body, to promote deformation of the body upon the penetrator impacting the target. The body optionally has a bore extending at least partially therethrough that permits attachment of the penetrator at a second end of the body opposite the first end.

16 Claims, 5 Drawing Sheets

U.S. PATENT DOCUMENTS

| | | | | |
|---|---|---|---|---|
| 6,659,013 | B1 | 12/2003 | Kellner | |
| 6,772,695 | B2 | 8/2004 | Kellner | |
| 6,772,696 | B2 | 8/2004 | Kellner | |
| 6,845,717 | B1 | 1/2005 | Sauvestre | |
| 6,971,315 | B2 | 12/2005 | Knappworst et al. | |
| 2005/0123372 | A1 * | 6/2005 | Sato | 411/32 |
| 2007/0193468 | A1 | 8/2007 | Sauvestre | |
| 2007/0204758 | A1 | 9/2007 | Spatz et al. | |

OTHER PUBLICATIONS

Powerbelt Bullets, Platinum High Performance Series, unknown date, page, volume, Powerbelt Bullets.

Hexolit 32, Ddupleks products, http://www.ddupleks.Iv/EN/ddupleks_products/show/Hexolit32.

Dupo 28, Ddupleks products, http://www.ddupleks.1v/EN/ddupleks_products/show/Dupo28.

* cited by examiner

EXPANDING PROJECTILE

CROSS-REFERENCE TO RELATED APPLICATIONS

This application claims priority from and is a continuation-in-part application from U.S. patent application Ser. No. 11/977,373, filed Oct. 24, 2007 now abandoned, entitled "Expanding Projectile" that is hereby incorporated by reference and claims priority from U.S. Provisional Application Ser. No. 60/853,820, filed on Oct. 24, 2006, now abandoned.

FIELD OF THE INVENTION

The present invention relates to a projectile for firearms that may be capable of radial expansion.

BACKGROUND OF THE INVENTION

Projectiles for use as conventional ammunition are generally known and widely used. A sabot may be used with the projectile, which is common in hunting. A sabot is commonly used when the projectile (or ammunition) is smaller than the bore of the firearm. The sabot allows firing projectiles smaller than the bore of the firearm while maintaining range and overall performance of other types of ammunition. Typically, the projectile is inserted into the sabot and together the projectile and sabot is forced downward into the bore of the firearm, such as a muzzleloading firearm. The interaction of the projectile and the sabot results in the sabot frictionally contacting the contours of the bore as the projectile and sabot are loaded and forced into the firearm. Overcoming the friction between the sabot and the bore of the firearm requires additional force that is undesirable to a user of the firearm. Therefore, it is desirable for a projectile that may reduce the friction between the sabot and the bore of the firearm.

It is also a desirable to improve the properties exhibited by the projectile, such as ability to expand, air resistance, accuracy, and the like. In use for hunting, for example, it is typically desirable for the projectile to expand to maximize penetration and damage to the target. However, one deficiency with known ammunition is that there is neither enough projectile expansion nor sufficient penetration upon impacting the target. The impact of known projectiles when used in hunting, for example, results in a potentially slow and inhumane game harvesting.

Prior ammunition is made of lead to enhance its deformability. However, lead penetration into game presents a potential health risk due to the toxicity of lead. Therefore, the present invention seeks to address these and other limitations and to provide an improved projectile.

SUMMARY OF THE INVENTION

An improved projectile having a penetrator and a body is disclosed. The penetrator may be positioned adjacent to a first end of the body. The penetrator may be secured to the body, such as by frictional engagement or by a fastening member. The body may have one or more portions to promote deformation of the body upon the penetrator impacting the target. The body may have a bore extending at least partially therethrough that permits attachment of the penetrator at a second end of the body opposite the first end. The bore may promote deformation by permitting the penetrator to travel into the bore to expand or at least deform the body.

Further features or embodiments of the invention will be described or will become apparent in the course of the following detailed description.

BRIEF DESCRIPTION OF THE DRAWINGS

The operation of the invention may be better understood by reference to the following detailed description taken in connection with the following illustrations, wherein.

DETAILED DESCRIPTION OF THE PREFERRED EMBODIMENTS

The present invention will now be described in accordance with the embodiments shown in FIGS. 1-14*b*. While some embodiments are described with reference to a projectile for a muzzle-loading firearm, it should be understood that the present invention may be used with other firearms, as will be appreciated by one of ordinary skill in the art.

Figure 1:
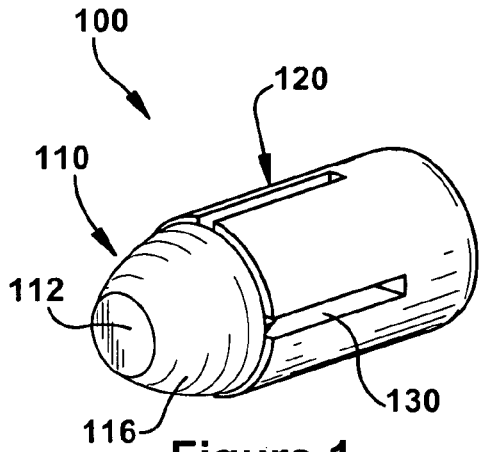
FIG. 1 is perspective view of a projectile in an embodiment of the present invention.
Figure 2:
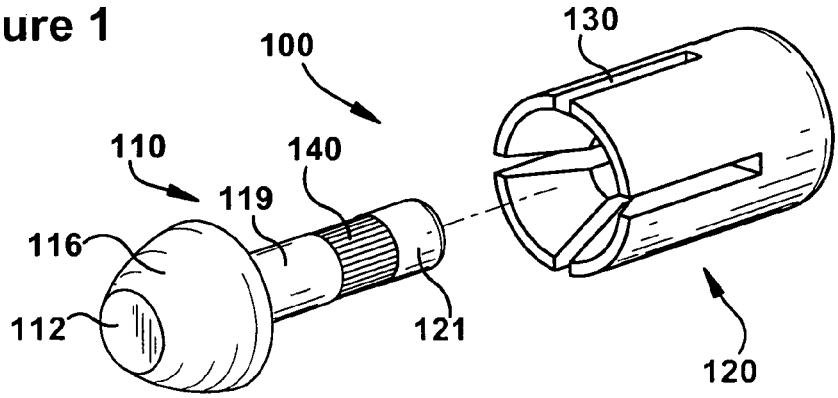
FIG. 2 is an exploded view of the projectile of FIG. 1.

As shown in FIG. 1, a projectile 100 generally comprises a penetrator 110 and a body 120. The penetrator 110 is generally shaped to impact a target, such as, a tangible object, an animal, and any other target as appreciated by a person of skill in the art. To this end, the penetrator 110 may be made of a durable material capable of causing damage to the target upon impact. In a preferred embodiment, the penetrator 110 is made of a non-lead material, such as steel, for example, AISI 1215 steel or AISI 1018 steel. Advantageously, the present invention may be provide a projectile capable of use in hunting, for example, without use of a toxic lead material.

Figure 3:
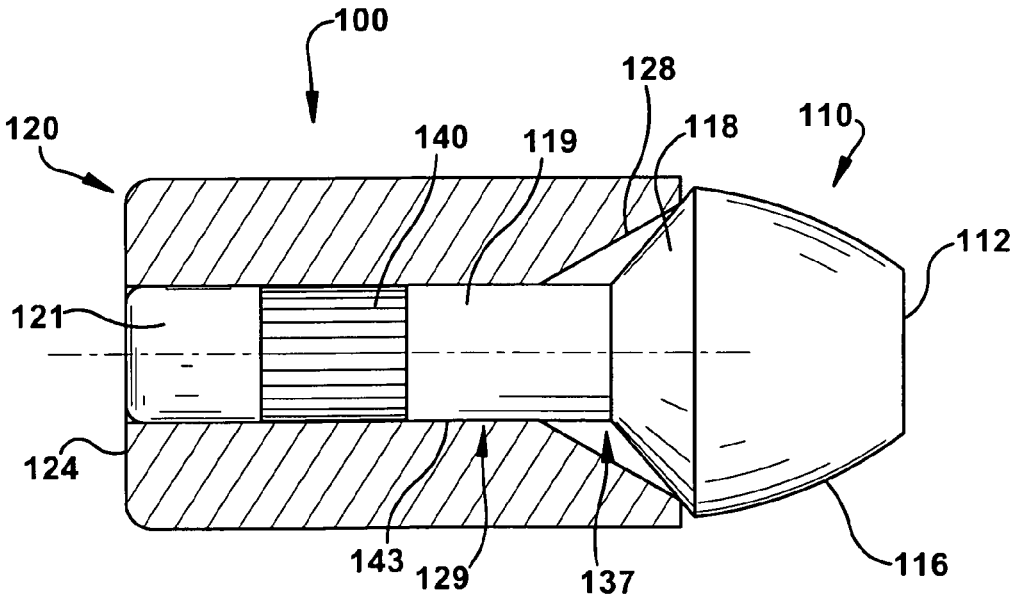
FIG. 3 is a partial cross-sectional view of the projectile in an embodiment of the present invention.

As shown in FIGS. 2, 3, 4*a*, 4*b*, the penetrator 110 may have a head portion 116 and a shoulder portion 118. The head portion 116 may face outward with respect to the body 120. The shoulder portion 118 may be positioned adjacent to the body 120. In an embodiment, the shoulder portion 118 may abut the body 120. The shoulder portion 118 may be shaped to aid the penetrator 110 in traveling into the body 120 upon the penetrator 110 impacting the target. The head portion 116 of the penetrator 110 may be shaped to improve aerodynamics of the projectile 100. In an embodiment, as shown in FIG. 3, the head portion 116 may be substantially rounded or parabolic in shape to improve the aerodynamics of the projectile 100. The head portion 116 may further include a substantially flat portion 112 near its end. The head portion 116 may be other shapes as will be appreciated by a person having ordinary skill in the art, such as but not limited to a pointed or bullet shape.

Figure 5A:
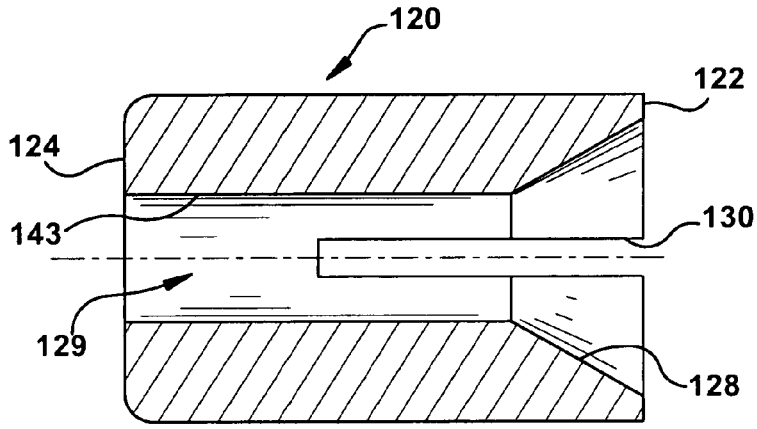
FIG. 5*a* is cross-sectional view of a body having a bore extending therethrough in an embodiment of the present invention.

The body 120 may be shaped to correspond to the shape of a bore (or barrel) of a firearm. For example, as shown in FIG. 5*a*, the body 120 may be generally cylindrical in shape. The body 120 may be fabricated or otherwise manufactured from any suitable material. In an illustrative embodiment, the body 120 is fabricated from a non-lead material, such as AISI 1018 steel or AISI 1215 steel. The body 120 and the penetrator 110 may be made of the same materials or different materials. As an example, the penetrator 110 may be made from AISI 1215 steel, and the body 120 may be manufactured from AISI 1215 steel. Such a combination provides a material with good machinability, while eliminating concerns over lead toxicity.

Although the projectile 100 is shown without a jacket, one of ordinary skill will appreciate that the projectile 100 may be jacketed for use with different applications or firearms. The body 120 and/or the penetrator 110 may be shaped or textured to improve aerodynamics of the body 120. In an embodiment, the body 120 and the penetrator 110 may have a surface treatment to improve aerodynamics, to resist corrosion, and/or to enhance the appearance of the projectile 100. The surface treatment may be an oxide, such as black oxide, a plating, an annealing or any other type of surface treatment known to a person having ordinary skill in the art.

Figure 7:
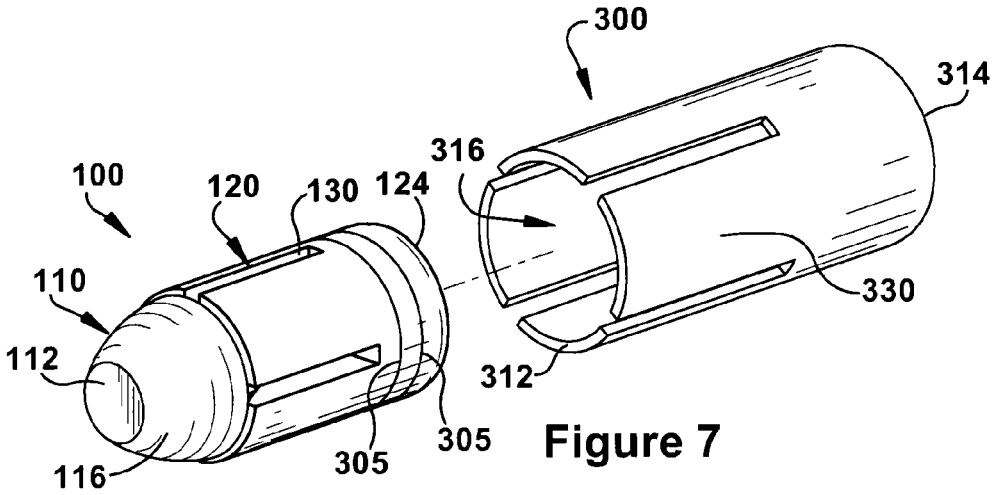
FIG. 7 is an exploded view of the projectile with a sabot in an embodiment of the present invention.

The body 120 may have a length defined between a first end 122 and a second end 124. The penetrator 110 may be positioned adjacent the first end 122 of the body 120. For example, the shoulder portion 118 of the penetrator 110 may abut the first end 122 of the body 120. The second end 124 may be sized and shaped to reduce contact and engagement with a sabot or such that the projectile 100 and the sabot may be inserted into a firearm with less frictional engagement of the sabot and the barrel or bore of the firearm. For example, in an embodiment, the second end 124 of the body may taper or otherwise decrease in size from the first end 122. As shown in FIG. 7, the body 120 may have one or more grooves or recesses 305. The grooves 305 may be indentations, apertures, perforations, craters or other structure that may reduce contact with a sabot that may be positioned about the projectile 100. The grooves 305 may be located adjacent the second end 124 to provide a reduction in material or to otherwise reduce expansion of the sabot and frictional engagement of the sabot with the bore of the firearm upon loading. For example, a sabot positioned about the projectile 100 may be forced down into the barrel of a firearm with a reduced amount of resistance due to the grooves 305 or the second end 124 having a tapered shape.

Figure 5B:
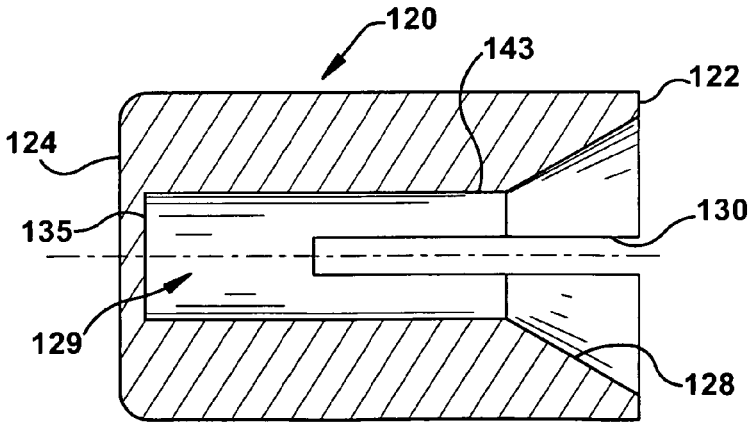
FIG. 5*b* is a cross-sectional view of a body having a bore termination within the body in an embodiment of the present invention.

The body 120 may have a bore or cavity 129 extending at least partially therethrough. As shown in FIG. 3, the bore 129 may extend from the first end 122 toward the second end 124. The bore 129 may extend through the second end 124 or, alternatively, as shown in FIG. 5*b*, may terminate, such as at wall 135. In an embodiment, the bore 129 may have a larger diameter adjacent the first end 122. For example, the bore 129 may have a tapered surface 128 reducing the diameter from the diameter at the first end 122. A gap 137 may be provided between the shoulder portion 118 and a portion of the tapered surface 128 to allow for easier setback of the head portion 116 upon object impact. It is to be understood that the illustrative examples are not limiting and that one of ordinary skill in the art will appreciate a variety of configurations between the first end 122 and the head portion 116 or the shoulder portion 118, and the tapered surface 128 and the head portion 116 or the shoulder portion 118.

The body 120 may have one or more portions 130 along the outer surface of the body 120. The portions 130 may be indentations, grooves, protrusions, slots or the like that permit or at least aid in deformation of the body 120, such as when the penetrator 110 impacts the target. The portions 130 may be located or positioned at or adjacent to the first end 122 of the body 120 and may extend a predetermined distance toward the second end 124 of the body 120. The portions 130 may have a thickness at the second end 124 less than a maximum thickness at the first end 124 of the body 120. FIGS. 1, 2, 3, and 7 illustrate the body 120 having the portions 130 in the form of slots having, no thickness, which by definition is less than the thickness of the first end 122 of the body 120. The portions 130 may be symetrically spaced about the body 120 and extending partially along the length of the body 120. In an embodiment, the portions 130 extend through the body 120 into an interior of the body 120. It is to be understood that the portions 130 may be of any depth into or through the body 120, as shown in FIG. 5*a*, and may vary in depth from the first end 122 to or toward the second end 124. The body 120 may have one or more of the portions 130 and should not be deemed as limited to any specific number of portions 130. In a preferred embodiment, the body 120 has six portions 130 spaced symmetrically about the body 120. The portions 130 may be any structure or modification to the body 120 that permits deformation of the body 120.

Figure 6A:
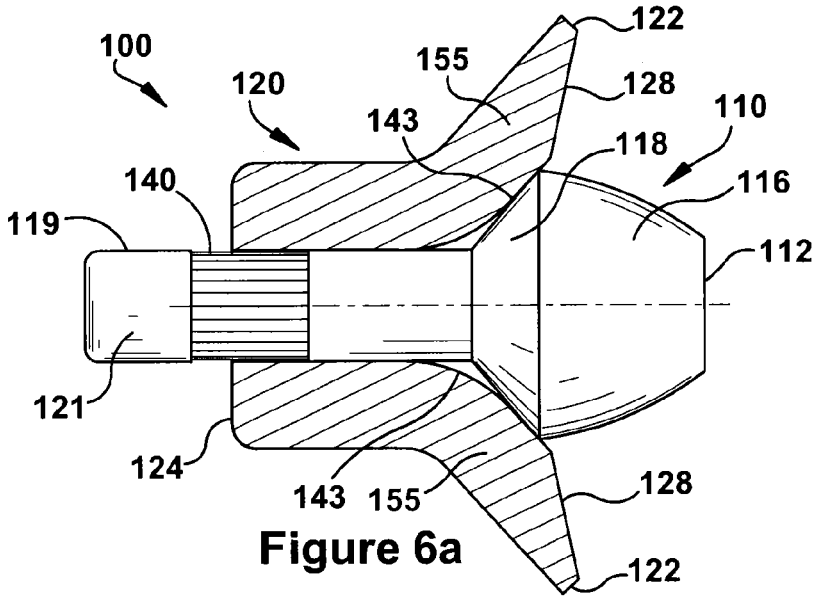
FIG. 6*a* is a partial cross-sectional view of a projectile after impact with a target in an embodiment of the present invention.
Figure 6B:
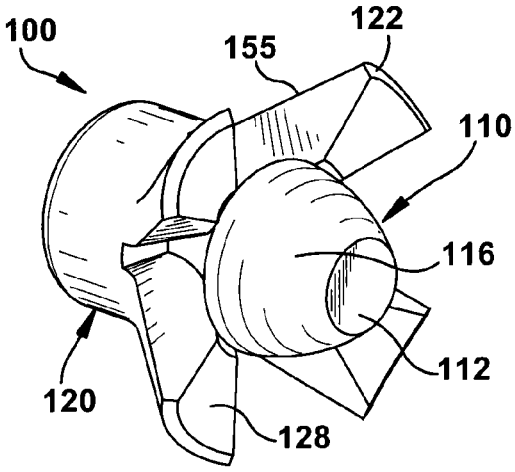
FIG. 6*b* is a perspective view of the projectile of FIG. 6*a*.
Figure 6C:
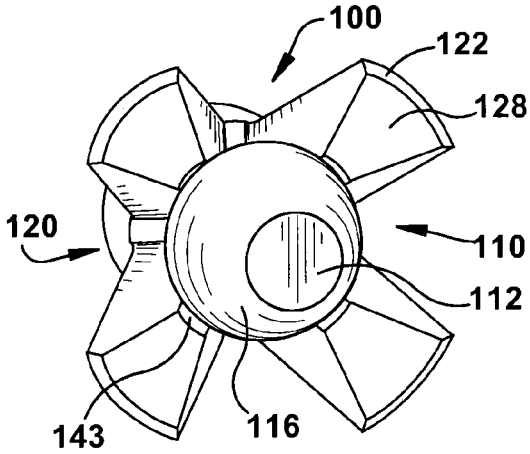
FIG. 6*c* is a frontal view of the projectile of FIG. 6*a*.

The portions 130 may serve as rupture initiators that promote deformation of the body 120, such as into petals 155 upon impact of the penetrator 100 with a target as shown in FIGS. 6*a*, 6*b* and 6*c*. In an illustrative example, the shoulder 118 may expand the tapered surface 128 at the deformable portions 130 outwardly. The penetrator 110, for example, may travel into the body 120 upon impacting a target causing the penetrator 110 to force the deformable portions 130 to expand or at least deform, such as shown in FIGS. 6*a*-6*c*. To this end, the deformable portions 130 may deform prior to the non-deformable portion (or other portions) of the body 120. In other words, the deformable portions 130 may be more easily deformable than the rest of the body 120.

The bore 129 may be hollow such that a shaft 119 may extend through the bore 129. The shaft 119 may secure the penetrator 110 to the body 120. The shaft 119 may be integrally formed with the penetrator 110 as shown in FIGS. 2, 3, 4*a*, 6*a* and 9. For example, the shaft 119 may extend from the shoulder 118 of the pentrator portion 110 of the projectile 100. In another embodiment, the shaft 119 may be separate from the penetrator 110. If the shaft 119 is not integrally formed with the penetrator 110, the shaft 119 may be secured to the penetrator 110. For example, the shaft 119 may be threaded onto or into the penetrator 110, and/or the shaft 119 may be press-fit onto the penetrator 110. The shaft 119 may have a shape corresponding to the bore 129, such as substantially cylindrical in shape.

The shaft 119 may include one or more protrusions 140 capable of frictionally engaging the shaft 119 to a cavity wall 143 of the body 120. Accordingly, the protrusions 140 are capable of securing the penetrator 110 to the body 120 until impact, when the frictional forces may be overcome, permitting the shaft 119 to travel axially into the body 120 toward or beyond the second end 124 of the body 120.

Figure 4A:
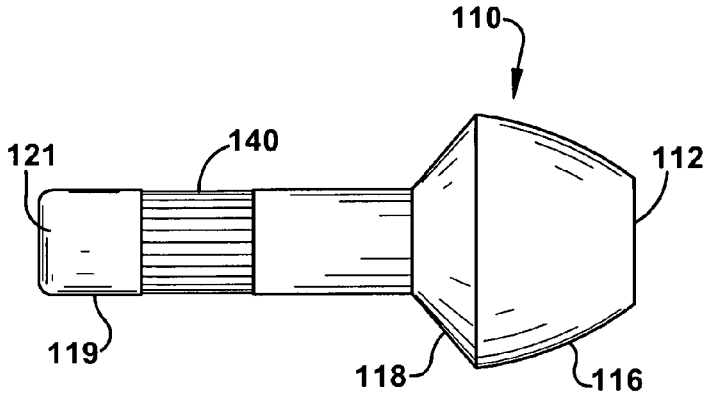
FIG. 4*a* is a perspective view of the penetrator.
Figure 4B:
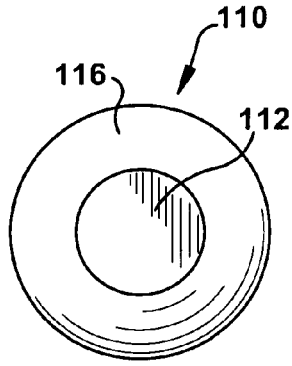
FIG. 4*b* is a frontal view of the penetrator.

In an illustrative example, the protrusion 140 may be longitudinal ridges or knurls, as shown in FIG. 4*a*, or may be teeth, roughened surfaces, or any other structure that frictionally engages the penetrator 110 with the body 120. Optionally, arrangements of o-rings, adhesives, frictional fits, or other arrangements may be used. For example, an o-ring (not shown) may be positioned between the penetrator 110 and the body 120 to secure the penetrator 110 to the body 120. Furthermore, a groove (not shown) may be included, for example, in either the shaft 119 or the cavity wall 143, into which the o-ring may be seated to more precisely position the o-ring.

Figure 8:
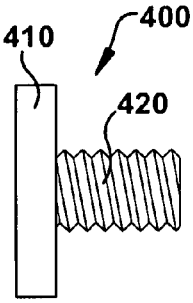
FIG. 8 is a cross-sectional view of a retention member in an embodiment of the present invention.

The shaft 119 may be secured to the body 120 in other manners. For example, as shown in FIG. 8, a retention member 400 may be provided to secure the penetrator 110 to the body 120. The retention member 400 may comprise a base 410 and a leg 420 extending therefrom as best shown in FIG. 8. It is to be understood that the retention member 400 may be formed from any suitable material such as, but not limited to, a material similar or identical to the penetrator 110 or body 120.

Figure 9:
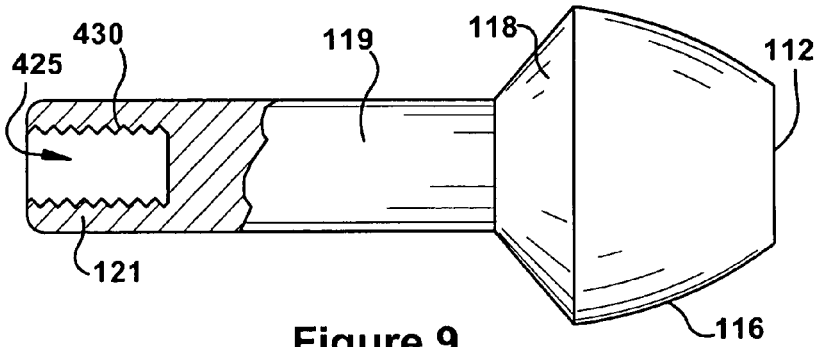
FIG. 9 is a cross-sectional view of a penetrator having a cavity or bore in an embodiment of the present invention.
Figure 10:
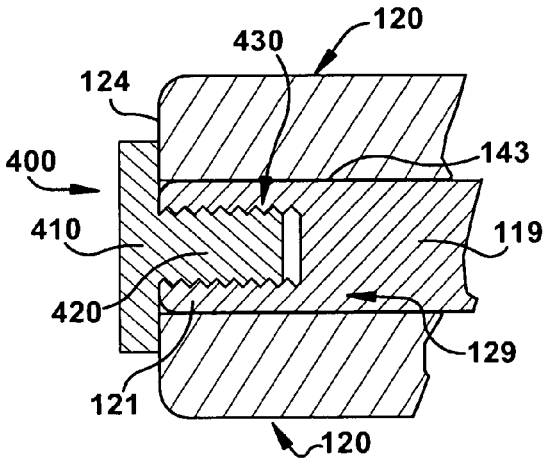
FIG. 10 is a cross-sectional view of a projectile second to a body in an embodiment of the present invention.

As shown in FIG. 9, the penetrator shaft 119 may be provided with a cavity 425 defined by inner wall 430 and accessible at the end 121. As best shown in FIG. 10, an inner wall 430 of the shaft 119 may receive the leg 420 so that the base 410 abuts the body end 124. In a non-limiting example, the leg 420 may be threadingly secured to the inner wall 430. The base 410 may be provided with a drive point (not shown) to facilitate rotation of the retention member 400 to threadingly secure the leg 420 to the shaft 119. It is also to be understood, however, that one of ordinary skill in the art will appreciate that a variety of structures may be used to secure the leg 420 to the shaft 119 including, but not limited to adhesives, or-rings, friction fits, and the like.

Figure 11:
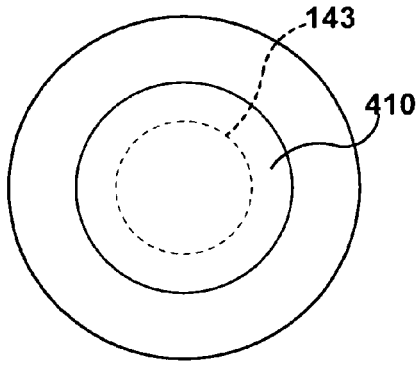
FIG. 11 is an overhead view of a retention member secured in the penetrator in an embodiment of the present invention.
Figure 12:
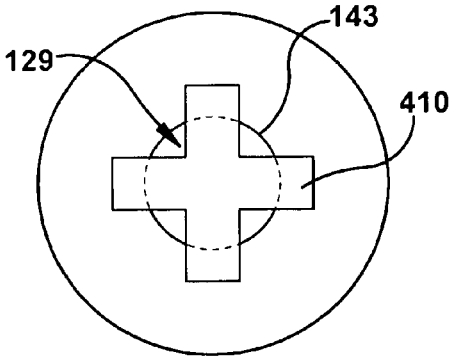
FIG. 12 is an overhead view of the retention member positioned on the body in an embodiment of the present invention.
Figure 13:
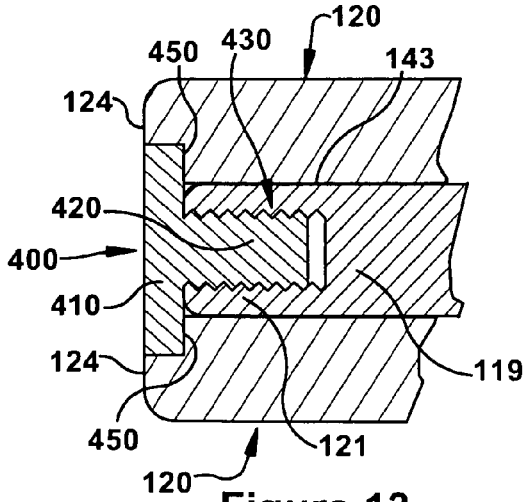
FIG. 13 is a cross-sectional view of the projectile in an embodiment of the present invention.

The base 410 may be provided in a variety of shapes. As shown in FIG. 11, the base 410 may be substantially circular and may have a larger diameter than the cavity 129 defined by the cavity wall 143. In another illustrative example, as shown in FIG. 12, the head may be substantially cross-shaped so that at least a portion of the base 410 extends across the cavity 129 along end 124. Although shown in FIGS. 11 and 12 as extending only along a portion of the end 124, it is to be understood that the base 410 may span the entire diameter of the end 124. In another illustrative example, as best shown in FIG. 13, the body 120 may be provided with a recess 450 for receiving the base 410 therein. Such a configuration provides a flush fit of the base 410 with the second end 124 of the body 120.

The base 410 may be positioned at the end 124 so that the penetrator 110 maintains its connection to the body 120 prior to or during firing. The base 410 may prevent the penetrator 110 and body 120 from separating upon impact with the target. For example, the retention member 400 is secured to the penetrator 110 so that the body 120 is sandwiched between the base 410 and the head portion 116 of the penetrator 110. The retention member 400 is capable of securing the penetrator 110 to the body 120 so that there may be a gap between the shaft 119 and the cavity wall 143. Accordingly, the retention member 400 secures the penetrator 110 to the body 120 to prevent the shaft 119 from traveling axially through the cavity 129 towards the first end 122 of the body 120 while allowing the shaft 119, upon impact of the head 116 with an object, to travel axially through the cavity 129 towards the second end 124. In an embodiment, at least a portion of the shaft 119, such as the end 121, may extend beyond the second end 124.

The retention member 400 may be used with or without the protrusions 140. For example, the surface of the shaft 119 opposite the cavity wall 143 may be substantially smooth. Such a configuration eliminates, or substantially decreases, the frictional force between the shaft 119 and the cavity wall 143. Accordingly, the penetrator 110 may incur less resistance from the body 120 when the penetrator impacts an object, which may result in a greater deformation of the body 120 upon impact or entry into the target.

Figure 14A:
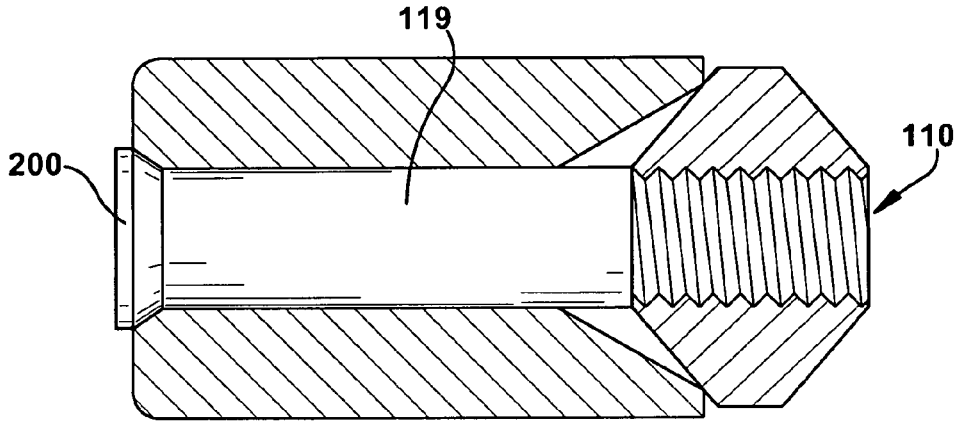
FIG. 14*a* is an exploded cross-sectional view of a projectile having a shaft with an enlarged head in an embodiment of the present invention.
Figure 14B:
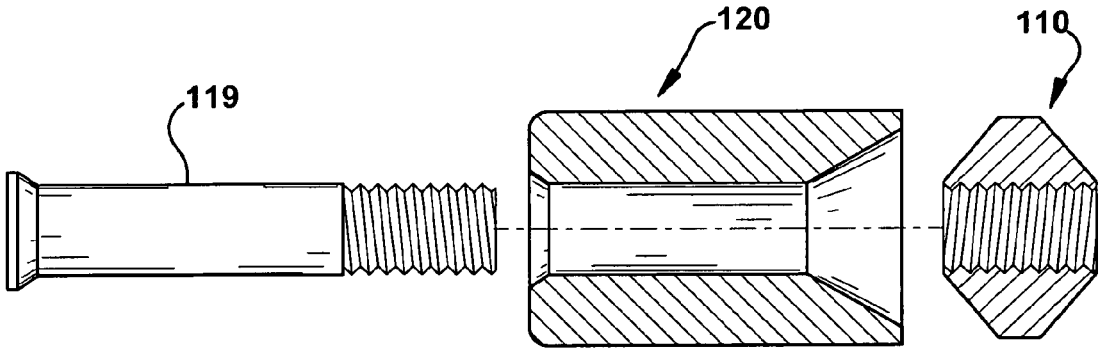
FIG. 14*b* is a cross-sectional view of the body having a shaft securing the penetrator to the body in an embodiment of the present invention.

Another non-limiting example of securing the penetrator 110 to the body 120 involves an enlarged end 200 on the shaft 119 as shown in FIGS. 14*a* and 14*b*. The enlarged end 200 may be larger in size and in shape than the bore 129. To this end, the enlarged end 200 may prevent the shaft 119 from sliding or axially moving through the bore 129. The end of the shaft 119 opposite the enlarged end 200 may be secured to the penetrator 110 in any manner known to a person having ordinary skill in the art. For example, the penetrator 110 may be welded, molded, adhered, frictionally fit, or press fit onto the shaft 119. In a preferred embodiment, the penetrator 110 is secured by threads to the shaft 119. For example, the shaft 119 may have male threads that engage female threads within the penetrator 110. Accordingly, the shaft 119 may secure the penetrator 110 to the body 120. The penetrator 110 and the body 120 may be secured together such that they remain connected after the projectile has impacted the target. Therefore, the projectile 100 may be easily removed from the target without requiring a user to locate and remove the penetrator 110 separate from the body 120. The projectile 100 may have the portions 130 spaced about the body 120. In an embodiment, the body 120 has six of the portions 130 spaced about the body 120.

As shown in FIG. 7, a sabot 300 having a proximal end 312 and a distal end 314 may be provided with the projectile 100. The proximal end 312 of the sabot 300 defines an opening 316 within the sabot 300 that is capable of receiving the projectile 100. The opening 316 may be sized and shaped to receive the second end 124 of the body 120 and at least a portion of the body 120. The sabot 300 may include one or more slots 330 extending from the proximal end 312 and along its sides. The slots 330 may be substantially parallel to the length of the sabot 300. The slots 330 may form one or more petal-like structures that permit insertion of the projectile 100 into the sabot 300. The sabot 300 may expand upon insertion of the projectile 100, such as by expansion of the petal-like portions between the one or more slots 330. The one or more grooves 305 can be optionally machined on the body 120, such as the surface in that may contact the sabot 300. The grooves 305 may reduce frictional forces that a user must overcome when loading the projectile-sabot combination down the barrel of a firearm, such as a muzzle-loading rifle.

In use, the projectile 100 may be inserted into the sabot 300. The projectile 100, with or without the sabot 300, may be pushed and forced downward into the barrel or bore of a firearm. When a sabot 300 is used, the projectile 100 is fired from the firearm, the sabot 300 and projectile 100 travel together. The sabot 300 strips away from the projectile 100 by wind resistance, and the projectile 100 continues toward the target. Upon impacting the target, such as the body of an animal, the head portion 116 of the penetrator 110 may first contact the target. The resulting impact causes the penetrator 110 to impart a force onto the body 120 to deform and enlarge the body 120. For example, the head portion 116 of the penetrator 110 or the impact with the target may drive the portion 130 outward from the body 120. The shaft 119 then moves with the penetrator 110 axially into the bore 129 to deform the body 120. The head portion 116 and the shoulder portion 118 acts as a wedge on the tapered surface 128 and cavity walls 143, expanding the first end 122 of the body 120 as shown in FIGS. 6*a*-6*c*. The penetrator 110 and the body 120 remain secured together upon impacting the target.

The head portion 116 permits the projectile 100 to penetrate the target as the body 120 expands. The ability of the shaft 119 to continue driving through and beyond the second end 124 allows for greater expansion of the body 120, thereby increasing the effectiveness of the projectile 100. Thus, the projectile 100 exhibits the characteristics of both improved projectile expansion and penetration upon impacting the target, which, for example, promotes quick and humane harvesting of game while hunting. Moreover, this product, unlike the majority of rifle projectiles, may be constructed with substantially lead-free materials. This enables the use of this projectile in areas where lead toxicity is a concern.

The invention has been described above and, obviously, modifications and alterations will occur to others upon a reading and understanding of this specification. The claims as follows are intended to include all modifications and alterations insofar as they come within the scope of the claims or the equivalent thereof.

What is claimed is:

1. A projectile for impacting a target comprising:

a penetrator comprising a head connected to a shaft;

a body having a length defined between a first end and a second end and a bore extending therethrough, the head positioned adjacent to the first end of the body and the shaft extending to the second end, the body having a thickness separating an interior from an exterior of the body, wherein the body is contained within a sabot; a plurality of slots extending through the body and located adjacent the first end;

wherein the end of the shaft opposite the penetrator is enlarged to be wider than the opening of the bore at the second end of the body and protrudes beyond the furthest extent of the second end of the body; and wherein upon impacting a target, the head is designed to slide toward the body to cause expansion of the portions of the body between the slots.

2. The projectile of claim 1 wherein the penetrator is secured to the second end of the body.

3. The projectile of claim 1, wherein the shaft extends from the second end of the body to the first end of the body.

4. The projectile of claim 3 wherein the shaft is in threaded engagement with the head.

5. The projectile of claim 1 wherein the body and the penetrator are surface treated.

6. The projectile of claim 1 wherein the bore extends through the second end of the body, and further wherein the head has a size greater than the cross-sectional opening of the bore.

7. The projectile of claim 6 wherein the shaft is threadingly secured to the penetrator.

8. The projectile of claim 1 wherein the body comprises a tapered portion between each slot to engage a similarly tapered portion of the head.

9. A projectile for impacting a target comprising:

a body having a length defined between a first end and a second end and a bore extending from the first end to the second end, wherein the body includes a plurality of slots extending therethrough, wherein the body is contained within a sabot; a shaft positioned within the bore and extending through the body;

a head connected to the shaft at a first end of said shaft;

a retention member having a portion that is wider than the opening of the bore at the second end of the body connected to a second end of said shaft, the retention member configured to protrude beyond the furthest extent of the second end of the body; and wherein upon impacting a target, the head is designed to slide toward the body to cause expansion of the portions of the body between the slots.

10. The projectile of claim 9, wherein the retention member is connected to said shaft.

11. The projectile of claim 9 wherein the shaft has a head that is larger in size than the bore.

12. The projectile of claim 9 wherein the shaft is in threaded engagement with the head.

13. The projectile of claim 9 wherein the shaft is integrally formed with penetrator.

14. A projectile for impacting a target comprising:

a penetrator comprising a head in threaded engagement with a shaft;

a body secured to the penetrator, the body having a length defined between a first end and a second end and a plurality of slots extending through the body, the head positioned adjacent to the first end and the shaft extending to the second end of the body and secured to body at the second end, wherein the body is contained within a sabot, wherein impact of the penetrator into the target causes the penetrator to deform the body;

a retention member having a portion that is wider than the opening of the bore at the second end of the body connected to a second end of said shaft, the retention member configured to protrude beyond the furthest extent of the second end of the body; and wherein upon impacting a target, the head is designed to slide toward the body to cause expansion of the portions of the body between the slots.

15. The projectile of claim 14 further comprising a bore extending from the first end of the body and toward the second end of the body.

16. The projectile of claim 15 wherein the head is greater in size than the bore at the second end of the body.

* * * * *